US005215408A

United States Patent [19]

Zimmerman

[11] Patent Number: 5,215,408

[45] Date of Patent: Jun. 1, 1993

[54] PROTECTIVE ELEMENT FOR PROTECTING SEALED TRACKS IN TRASH-DUMP CONSTRUCTION AND METHOD FOR SEALING TRASH-DUMP BOTTOMS

[75] Inventor: Jurgen Zimmerman, Salzgitter, Fed. Rep. of Germany

[73] Assignee: Gebruder Friedrich, Fed. Rep. of Germany

[21] Appl. No.: 679,905

[22] Filed: Apr. 3, 1991

[30] Foreign Application Priority Data

Apr. 3, 1990 [DE] Fed. Rep. of Germany ..... 4010636
Nov. 13, 1990 [EP] European Pat. Off. ..... 90 121719.0

[51] Int. Cl.[5] ..... B09B 1/00

[52] U.S. Cl. ..... 405/129; 405/128; 405/270

[58] Field of Search ..... 405/15-19, 405/258, 270, 128, 129

[56] References Cited

U.S. PATENT DOCUMENTS

| | | | |
|---|---|---|---|
| 4,467,015 | 8/1984 | Clen | 405/263 X |
| 4,572,705 | 2/1986 | Vignon et al. | 405/16 |
| 4,726,708 | 2/1988 | Papetti | 405/19 |
| 4,943,185 | 7/1990 | McGuckin et al. | 405/38 X |

FOREIGN PATENT DOCUMENTS

| | | | |
|---|---|---|---|
| 560165 | 9/1957 | Belgium . | |
| 0274564 | 7/1981 | European Pat. Off. . | |
| 0223223 | 9/1988 | Japan | 405/258 |
| 0131727 | 5/1989 | Japan | 405/258 |
| 0146021 | 6/1989 | Japan | 405/258 |
| 0146022 | 6/1989 | Japan | 405/258 |
| 2054013 | 2/1990 | Japan | 405/19 |
| 8101171 | 10/1982 | Netherlands | 405/17 |
| 1469008 | 3/1989 | U.S.S.R. | 405/258 |
| 970805 | 9/1964 | United Kingdom | 405/17 |
| 1439201 | 6/1976 | United Kingdom | 405/19 |

OTHER PUBLICATIONS

Tech Textil 3. 4, Dr. G. Schwarz, May 21, 1990.

*Primary Examiner*—Dennis L. Taylor
*Attorney, Agent, or Firm*—Joseph W. Berenato, III

[57] ABSTRACT

An object of the invention is rapid fabrication of sealed tracks for trash-dump construction to assure reliable protection even on slopes The invention proposes a protective element (1,15,21,33) in the shape of a shallow container with essentially constant height that receives a filling of sand (10,36)or a sand-like bulk material and which spans its space in such a way that a plurality of such can be laid as a gapless compound into a protective layer

19 Claims, 3 Drawing Sheets

PROTECTIVE ELEMENT FOR PROTECTING SEALED TRACKS IN TRASH-DUMP CONSTRUCTION AND METHOD FOR SEALING TRASH-DUMP BOTTOMS

The invention concerns a protective element for protecting sealed tracks in trash-dump construction and also a method for sealing the bottoms of trash-dumps using this protective element.

The construction of trash dumps requires that the bottom be absolutely sealed. This is achieved in the state of the art by placing a mineral basic seal on the dug bottom and depositing thereon a polymer sealed track or layer which consists of adjacent sealing strips fused tightly into each other at their sheet edges. To prevent the sealed track or layer from being mechanically damaged by the material which shall be placed upon it, in particular to avoid piercing it, the state of the art provides mounting protective elements on the sealed layer, and thereafter a layer of gravel with 16/32 mm grain size is put in place for surface draining.

Protective elements in the form of composites are known, which consist of a high-strength support fabric evincing great resistance to piercing and of fiber web stitched onto it. These elements therefore form a needled felt with a very strong support fabric and the are deposited with the fabric side upward on the sealed track or layer. They serve to bear part of the loads and to distribute them. As a rule however a further protective layer about 10 cm thick of sand must be then added. In the earlier and as yet unpublished German patent application P 40 00 653.0 this layer of sand can be eliminated provided that the protective track be equipped with a foam layer at least 3 cm thick and preferably present at the lower side of the support fabric.

Nevertheless a sand layer remains the ideal protection against damage to the sealed track caused by the layer of gravel and trash on top. But the integration of this protective sand layer raises significant problems precluding the use of construction machinery on account of the risk of damage to the sealed track; on the other hand preparation of the sand layer by wheelbarrow and shovel is too expensive. Moreover this manual integration does not ensure uniform minimum thickness, and as a precaution more sand is deposited than required for protection. Further, the sand layer is so displaced by the footprints of the people walking on it that it will be too thin in spots. Again where the slopes of the trash-dump pit are concerned, difficulties are encountered keeping the sand on them. Frequently the sand slips, and the sealed track is inadequately protected on such slopes.

The object of the invention is to create a protective layer to protect sealed tracks or surfaces in trash-dump construction, which can be made quickly and offers reliable protection also on the slopes.

This problem is solved in the invention by a protective element in the form of a shallow container of essentially constant height filled with sand or a similar bulk material and of such design that a plurality of such elements can be laid in place in gapless manner to form a protective layer.

The protective element of the invention is characterized by enormous advantages. It can be arrayed quickly and simply into a protective layer by so arranging the protective elements that they link up in gapless manner. The size of the protective elements should be such that they can be carried by one and at most by two persons. Especially when the shallow container is closed at the top, the thickness of the sand layer shall remain invariant under the treading of the persons arranging these protective elements. Thereby the sand layer is of the same thickness everywhere and as a result the height of the sand layer and hence of the protective element can be lowered to just the required size. This protective element is especially advantageous on slopes since the sand no longer can slip. Accordingly the same sand thickness also is ensured there.

As shown by experiment, a sand layer height which is significantly lower than the height of poured sand layers suffices when using the protective element of the invention. Excellent protection already is achieved with heights of 5 cm, even with heights of 2 cm.

To develop the basic concept of the invention, the shallow container shall be a sealed, preferably fully filled bag with bending-slack walls. Such a shallow container can be made simply and economically from various materials. Spacers, for instance in the form of boundary bands, shall be mounted to and distributed over the bag inside so that when being filled and also during its ensuing shipping, the bag shall retain its shallow shape, in other words, so that it shall not spread. Suitable materials are correspondingly tear-resistant sheets. The bags shall be especially appropriate when the walls consist of a textile impermeable to the filling, for instance a fabric or a knit, in particular Raschel wares. Their threads ought to consist of polypropylene (PP) or high density polyethylene (HDPE) or a mixture thereof, these synthetics being especially resistant. It was found advantageous as regards the dimensional stability of the textile shallow containers to provide the textile with a stabilizing coating, for instance of polyethylene (PE), in particular LLDPE or HDPE. As a result the tendency of the textile to stretch and of the threads to shift is averted and the sealing of the filling material is improved. Moreover the walls are rendered fairly impermeable thereby and flushing out the filling material is thus prevented.

The boundary bands appropriately consist of polyester, this material being especially resistant to stretching and thus securing constant height.

In a further embodiment of the invention, the shallow container designed as a bag comprises laterally projecting overlap strips. These overlap strips will come to rest above or below the particular adjacent protective element during laying and in this manner they span the gap between the protective elements: as a result, the gravel cannot enter the gap between the protective elements and cannot reach the sealed track. The overlap strips can be bonded to the particular adjacent protective element or in the event such an element should be a fusible material, can be welded using a hot air supply or other thermal means. As a result the bonding of the protective elements is improved additionally. The width of the overlap strips depends on the particular conditions. Widths of 8 to 15 cm were found useful.

In a particularly advantageous mode, the overlap strips shall be wall extensions which are superposed as one surface on the other because in that case manufacture shall be especially simple. The two layers of the overlap strips then can be welded together, or be bonded and/or woven or knitted together.

In an alternative to the shallow container being a bag, it also may be a pan with raised side edges, this pan appropriately being closed at the top and being essentially filled all the way. Such a pan too can be put in place rapidly and simple to form a gapless protective layer compound.

The pan should be substantially filled. Especially advantageously, the pan shall comprise partitions inside of it to still better hold the sand in it. The pan thereby acquires additional high dimensional stability simplifying its laying and its shipping. This will be the case in particular where the partitions are crossing and preferably orthogonally crossing. Appropriately the partitions shall rise from the bottom and shall be at least as high as the sidewalls.

The bottom of the pan should be plane and, in its simplest embodiment mode and just as is the case for the above described shallow container, shall evince a right parallelipiped shape. Obviously other shapes also may be employed provided they lend themselves to be completely covered in the compound.

To prevent gravel from slipping in between the protective elements, the pan side walls should be so shaped that they shall partly overlap when being laid in position. This can be achieved by making the particular opposite sidewalls complementary to each other, whereby, when being abutting, they shall match and hence overlap. Illustratively this can be done by bevelling the particular opposite sidewalls by the same angle. Better yet, the sidewalls shall be stepped in complementary manner so that the steps will superpose when the elements are abutting. Appropriately the sidewall steps shall be at half height.

An appropriate pan material must afford on one hand adequate strength to the protective element when it is being shipped and on the other hand it must be so compliant or soft enough not to jeopardize the sealed layer itself. Plastics such as rigid foams made of polystyrene or the like are applicable.

A method for making the aforementioned protective elements may be carried out in such a way that initially a pan open at the top is made using a plastic and in that thereupon a layer of sand is filled into it in continuous manner. An especially advantageous method is characterized by forming mutually orthogonal partitions in the pan which rise from its bottom, the first partitions extending in one direction projecting by some amount over the second partitions transverse to them, said amount corresponding to the spacing of the first partitions, and by the projections of the first partitions being bent after sand filling around the second partitions to provide a closed top side. Obviously the pan also may be closed merely using a lid.

Lastly another object of the invention is a method for sealing trash-dump bottoms wherein a sealed track or surface is deposited on a prepared surface of the trash-dump bottom and then a layer of sand is deposited to protect the sealed track against damages. In the invention, the sand or the sandlike bulk-good shall be first filled at essentially constant height into shallow containers and then be put in place into a gapless compound. The shallow containers may be of the aforementioned designs of the protective element of the invention. Appropriately the protective layer shall be white or metallic-colored at the top so that for solar irradiation the protective layer will not heat excessively as otherwise shifting of the sealed track might ensue. Obviously an additional protective layer of GEOTEXTIL may be placed between the protective layer and the sealed track. Such a track also may be deposited on the arrayed protective elements: this feature would be useful to separate the sand layer and the gravel above if the shallow container were a degradable plastic. The Geotextil should consist of a resistant plastic, for instance PEHD.

The drawing shows embodiments of the invention in closer detail.

Figure 1:
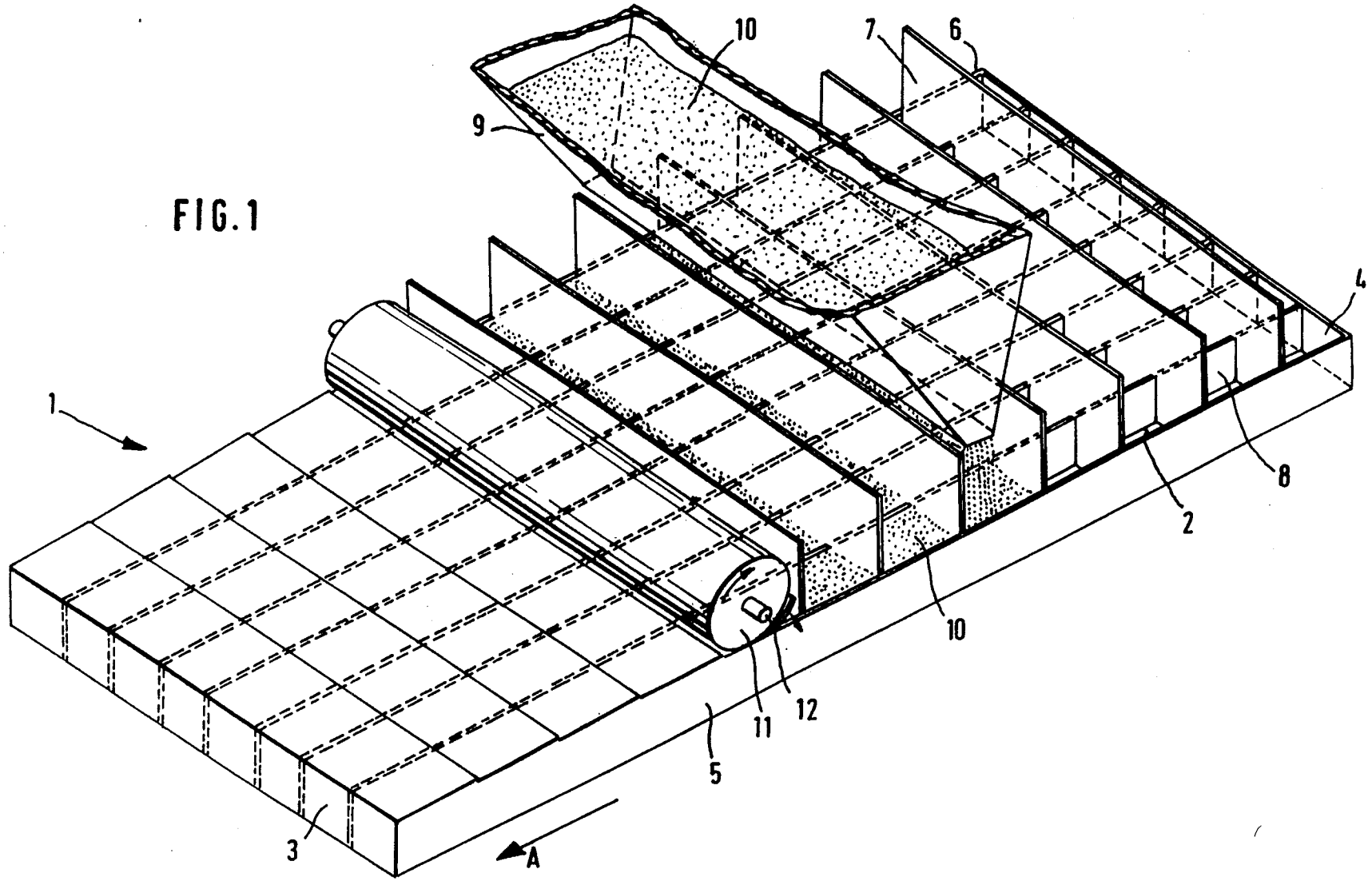
FIG. 1 is a perspective of a protective element being manufactured.

FIG. 1 shows a protective element in the shape of a right parallelipiped with a bottom 2 and four low sidewalls 3,4,5,6. The said walls rise erect from the bottom 2.

Equidistant first partitions illustratively denoted by 7 rising vertically from the bottom 2 extend parallel to the short sidewalls 3, 4 and initially project upwardly some distance beyond the sidewalls 3,4,5,6. Transversely thereto and parallel to the long sidewalls 5, 6 there extend second partitions illustratively denoted by 8 of which the height corresponds precisely to the height of the sidewalls 3,4,5,6. The first and second partitions 7,8 extend over the entire length between the particular sidewalls 5,6 or 3,4 which limit them, whereby the inside of the protective element is subdivided into right parallelipipeds.

A sand hopper 9 filled with sand 10 is present above the protective element 1. Its width matches that of the protective element 1. Moreover a roll 11 is provided, which rests rotatably on a horizontally supported shaft 12 extending parallel to the sidewalls 3, 4. The roll 11 is mounted in such a way that its circumference at the lower side is located approximately at the height of the sidewalls 5,6.

The initial fabrication of the protective element 1 takes place in such a manner that all the first partitions 7 project upward in the above described manner. Thereupon, using a conveyor means not shown in further detail, the element is first moved in the direction of arrow A underneath the sand hopper 9. Then discharge valves not shown in further detail are opened at the lower part of said hopper. Thereupon the protective element 1 is moved so slowly underneath the sand hopper that the outflowing sand shall sequentially fill the inside up to the upper edge of the sidewalls 3,4,5,6.

Next the protective element 1 moves underneath the roll 11. This roll 11 then bends downward the upwardly projecting segments of the first partitions 7 and thereby closes in segments the upper side of the protective element 1. The roll 11 may be heated to facilitate folding and to make possible welding the bent segments to the upper edges of the second partitions 8. In the example shown, already four projecting parts of the first partitions 7 have been folded whereas the rear part of the protective element 1 is still being filled with sand 10. After the protective element 1 has moved altogether underneath the roll 11, its upper side has been closed.

Once these protective elements 1 have been made, they may be put in place next to one another on a sealed track to seal a trash-dump bottom. For reasons of safety, an additional Geotextil may be inserted between the protective elements 1 and the sealed track. Furthermore, a fabric also may be deposited on the top side.

Figure 2:
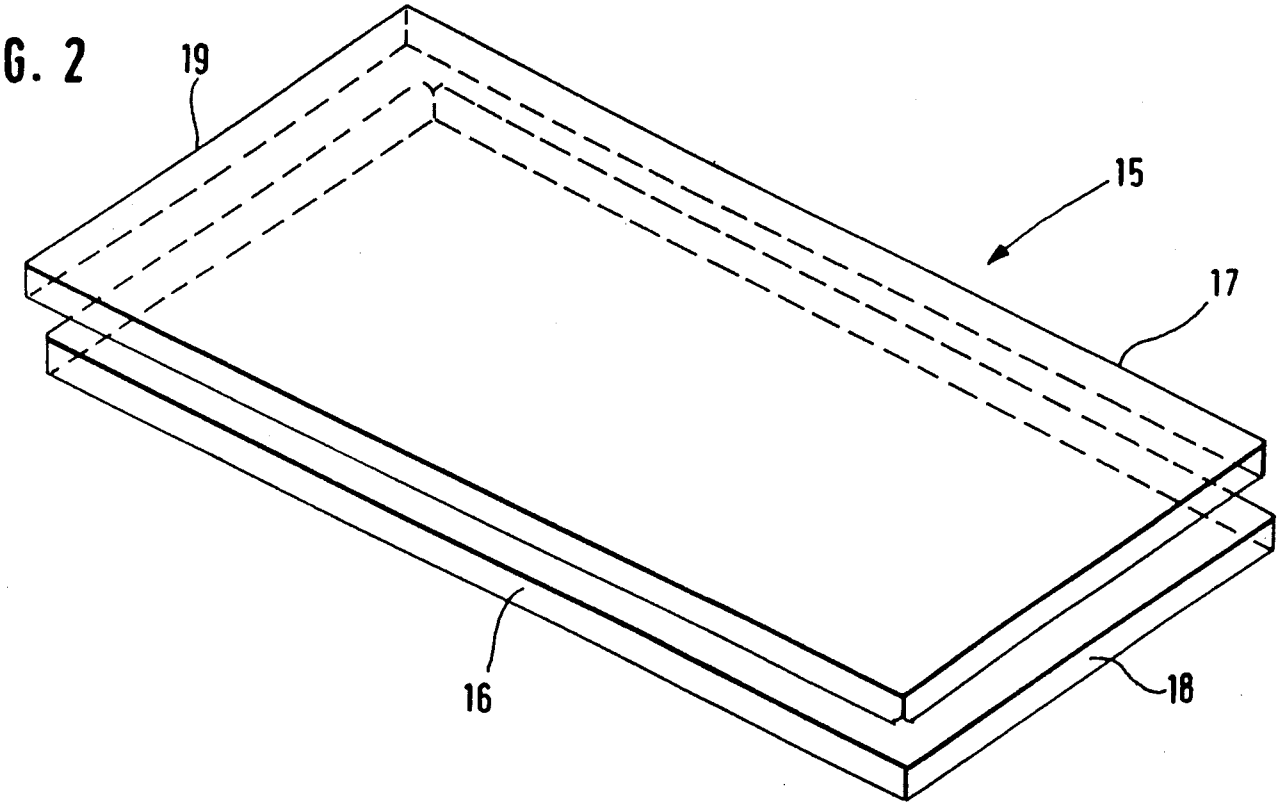
FIG. 2 is a perspective of another protective element.
Figure 3:
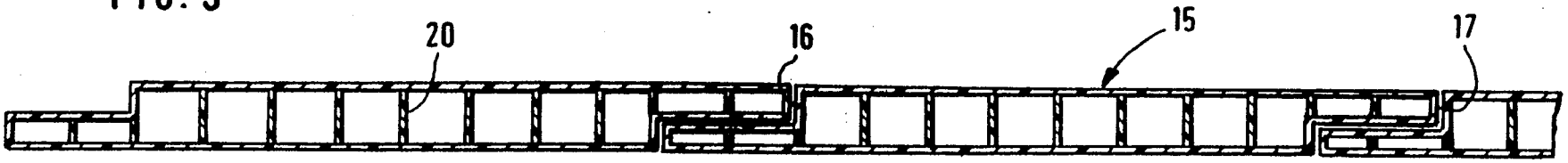
FIG. 3 is a cross-section of several protective elements of the kind shown in FIG. 2.

FIGS. 2 and 3 show a protective element 15 which is characterized by the special design of its sidewalls 16,17,18,19. The sidewalls 16,17,18,19 are offset to half height. The adjoining sidewalls 16,18 are upwardly recessed by a certain distance whereas the sidewalls 17, 19 project upward by the same distance. The long sidewalls 16,17 and the short sidewalls 18, 19 therefore are designed to complement, ie supplement each other.

This is shown even more clearly by FIG. 3 which is a vertical section of several adjacent protective elements 15. It will be noted that the projecting segments always superpose at the sidewalls 16,17,18,19 and therefore no gap exists when passing from one protective element 15 to another.

FIG. 3 moreover shows that the protective element 5 evinces the same subdivision as the protective element 1 of FIG. 1, i.e., again partitions here illustratively denoted by 20 are present inside the space.

Figure 4:
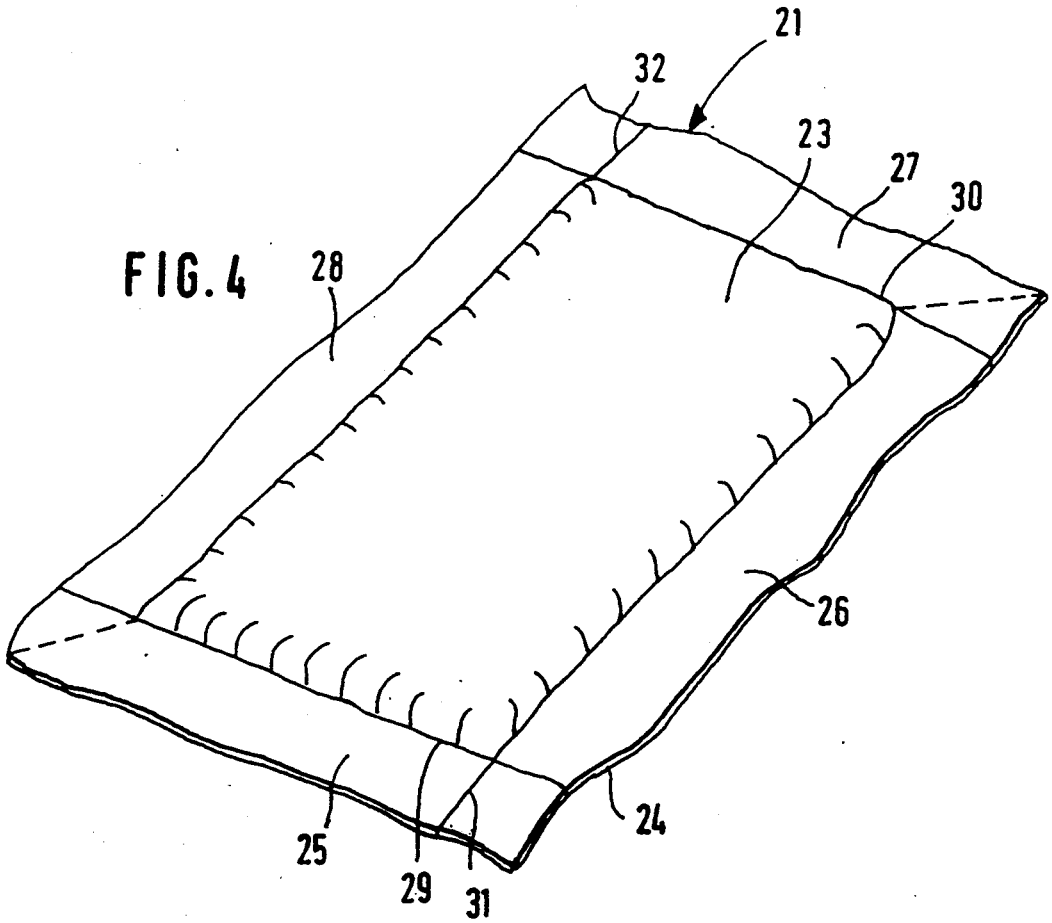
FIG. 4 is a perspective of a protective element designed as a bag.

FIG. 4 shows another protective element 21 designed as a closed bag. The protective element 21 consists of two superposed textile layers 23, 24. Both textile layers 23, 24 are in the form of HDPE strip fabrics, a stabilizing coating ensuring that the textile layers 23, 24 are resistant to stretching and shifting.

The two textile layers 23, 24 form overlap strips 25,26,27,28 at all edges. The textile layers 23, 24 are a really interwoven in the zone of the longitudinal overlap strips 26, 28 whereas they evince cross-seams 29, 30 in the zone of the transverse overlap strips 25, 27. The textile layers 23, 24 bulge inside the overlap strips 25,26,27,28 and essentially are spaced apart constantly by about 2.5 cm. The inside space so formed is filled with sand of a grain size from 0 to 3 mm.

Cuts 31,32 are present in the diagonally opposite corners and extend from the outer edges of the transverse overlap strips 25,27 to the cross-seams 29,30 in the extension of the inside edges of the longitudinal overlap strips 26,28. However these cuts 31, 32 also may be replaced by diagonal cuts as indicated in dashed lines at the other two corners.

This protective element 21 is made in such manner that the textile layers 23, 24 are made continuously by tubular weaving, the longitudinal overlap strips 26,28 being a really interwoven thereby. This textile tube then is cut transversely at appropriate distances and next the cross-seam 30 is stitched. Then the inside of the aperture formed by the overlap strip 25 is filled with sand up to the height of the cross-seam 29. Then that aperture is sewn shut up to the height of filling by the seam 29. Lastly the cuts 31, 32 are made.

Figure 5:
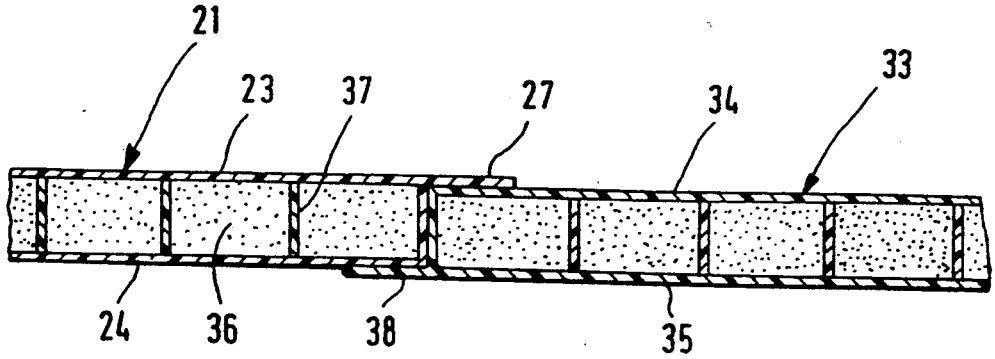
FIG. 5 is a cross-section of two protective elements of FIG. 4 which were made to abut.

The sectional representation of FIG. 5 shows parts of two adjacent protective elements 21,33. Both protective elements 21,33 consist of an upper and a lower textile layers 23, 24 and 34,35 resp. essentially the same distance apart and filled with sand 36. The distance between the textile layers 23,24 and 34,35 is set by boundary bands illustratively denoted by 37. These were already woven-in during the weaving process, initially obliquely, and as the sand 36 was filled in, they erected because of its displacement effect. This entails that for the embodiment of FIG. 4 the transverse overlap strip 27 shall be essentially flush in the end with the textile layer 23 whereas the opposite overlap strip 25 shall be flush with the lower textile layer 24. The boundary bands 35 furthermore assure that the protective elements 21, 33 shall evince the same height across the filling region of the sand 34, since they always are of the same length.

The protective elements 21,33 are tightly against each other at their end sides. The overlap strips 27,38 present there each time are laid over or under the neighboring protective element 21,33—ie., one overlap strip 27 is on the top side of the protective element 33 and the other overlap strip 38 is underneath the protective element 21. Thereby they span the gap between the two protective elements 21,33. Additionally they are welded by means of hot air to the particular textile layers 24 and 34 resp.

I claim:

1. A protective element for trash dumps, comprising:

a) first and second woven fabric layers, each layer has a first portion juxtaposed to the other layer, an edge portion, and an overlap portion;

b) means for operably interconnect cooperating lateral edges of said layers for defining therebetween an inside space;

c) a plurality of spaced boundary bands within said space spanning the distance between said lateral edges, each band operatively associated with each of said layers for setting the vertical distance therebetween when the inside space is filled; and d) means for operatively interconnect at least one of said edge portions to the adjacent layer transverse to said lateral edges for thereby closing the associated end of said inside space so that the associated overlap portion extends outwardly therebeyond in alignment with the associated layer.

2. The element of claim 1, wherein:

a) each edge portion is interconnected to the adjacent layer transverse to said lateral edges for thereby closing said inside space.

3. The element of claim 2, further comprising:

a) a bulk material fills said inside space.

4. The element of claim 3, wherein:

a) said bulk material is sand.

5. The element of claim 1, wherein:

a) said boundary bands are disposed in parallel and extend vertically.

6. The element of claim 5, wherein:

a) said boundary bands are of uniform dimension so that the distance between said layers is constant when said inside space is filled.

7. The element of claim 1, wherein:

a) each of said layers is formed from a high density polyethylene strip fabric.

8. The element of claim 1, wherein:

a) each of said layers is coated to resist stretching.

9. The element of claim 4, wherein:

a) each of said layers is a textile material impermeable to said sand.

10. The element of claim 1, further comprising:

a) a strip projects laterally beyond said lateral edges.

11. A protective element for trash dumps, comprising:

a) a woven tubular element having strips extending laterally therebeyond and further having first and second ends;

b) first and second overlap strips integral with and extending longitudinally from said element, said first overlap strip extending along a first portion of said element at said first end and defining thereby a first layer and said second overlap strip extending along a second portion of said element at said second end and defining thereby a second layer;

c) said first and second layers are stitched together adjacent said second overlap strip for thereby closing said second end; and d) a plurality of spaced bands are distributed within said element and are operatively associated with said layers for assuring an essentially constant distance between said layers when said element is filled.

12. The element of claim 11, wherein:

a) said bands are disposed in parallel array.

13. The element of claim 12, wherein:

a) said bands extend parallel to the stitching closing said second end.

14. The element of claim 11, wherein:

a) said element is coated for resisting stretching.

15. The element of claim 14, wherein:

a) said element is formed from high density polyethylene.

16. The element of claim 11, wherein:

a) said first and second layers are stitched together adjacent said first overlap strip for thereby closing said first end.

17. The element of claim 16, further comprising:

a) a bulk material fills said element.

18. The element of claim 17, wherein:

a) said bulk material is sand.

19. The element of claim 17, wherein:

a) said layers are spaced apart about 2.5 cm.

* * * * *